US010410806B2

(12) United States Patent
Nishino et al.

(10) Patent No.: US 10,410,806 B2
(45) Date of Patent: Sep. 10, 2019

(54) REACTION FORCE GENERATING MEMBER FOR A KEY SWITCH DEVICE

(71) Applicant: FUJITSU COMPONENT LIMITED, Tokyo (JP)

(72) Inventors: Takeshi Nishino, Tokyo (JP); Shuji Nakamura, Tokyo (JP); Akihiko Takemae, Tokyo (JP); Tamotsu Koike, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/610,771

(22) Filed: Jun. 1, 2017

(65) Prior Publication Data

US 2017/0271103 A1 Sep. 21, 2017

Related U.S. Application Data

(62) Division of application No. 14/558,794, filed on Dec. 3, 2014, now Pat. No. 9,741,507.

(30) Foreign Application Priority Data

Dec. 13, 2013 (JP) ..... 2013-257706
Jul. 4, 2014 (JP) ..... 2014-138828

(51) Int. Cl.
*H01H 9/26* (2006.01)
*H01H 13/72* (2006.01)
(Continued)

(52) U.S. Cl.
CPC ..... *H01H 13/7073* (2013.01); *H01H 13/14* (2013.01); *H01H 2215/004* (2013.01); *H01H 2227/036* (2013.01); *H01H 2235/002* (2013.01)

(58) Field of Classification Search
CPC ..... H01H 13/70; H01H 13/73; H01H 13/14; H01H 2215/004; H01H 2227/036;
(Continued)

(56) References Cited

U.S. PATENT DOCUMENTS 3,773,997 A 11/1973 Evans et al.
3,849,611 A 11/1974 Walker, Jr.
(Continued)

FOREIGN PATENT DOCUMENTS

CN 1177133 A 3/1998
CN 1604251 A 4/2005
(Continued)

OTHER PUBLICATIONS

Patent Abstracts of Japan, Publication No. 03-057114, published Mar. 12, 1991.
(Continued)

*Primary Examiner* — Anthony R Jimenez
(74) *Attorney, Agent, or Firm* — Staas & Halsey LLP

(57) ABSTRACT

A key switch device includes: an operation member to be depressed; a switch disposed below the operation member; a reaction force generating member that is provided between the operation member and the switch, performs elastic buckling deformation by depression of the operation member, gives a reaction force according to the elastic buckling deformation to the operation member; and a depression member that is provided between the operation member and the switch, and depresses the switch; wherein the reaction force generating member includes a supporter that supports the depression member.

15 Claims, 16 Drawing Sheets

(51) Int. Cl.
*H01H 13/76* (2006.01)
*H01H 13/7073* (2006.01)
*H01H 13/14* (2006.01)

(58) Field of Classification Search
CPC ..... H01H 2235/002; H01H 2203/04; H01H 2001/5888; H01H 2203/038; H01H 2203/05; H01H 13/52; H01H 1/06; H01H 5/04; H01H 50/30; H01H 50/546; H01H 3/00; H01H 3/02; H01H 3/32; H01H 3/60; H01H 5/00; H01H 69/00; H01H 71/00; H01H 2221/00; H01H 11/0056; H01H 11/00; H01H 13/44; H01H 13/48; H01H 2205/018; H01H 2205/026; H01H 2215/016; H01H 2215/024; H01H 2225/018; H01H 2239/004; H01H 2215/022; H01H 1/00; H01H 1/12; H01H 1/20; H01H 1/14; H01H 1/2025; H01H 1/22; H01H 1/36; H01H 1/50
USPC ..... 200/5 A, 288; 156/5 A
See application file for complete search history.

(56) References Cited

U.S. PATENT DOCUMENTS

| | | | | |
|---|---|---|---|---|
| 3,856,998 | A | 12/1974 | Sims, Jr. | |
| 4,515,999 | A | 5/1985 | Harper | |
| 4,584,444 | A | 4/1986 | Nagashima | |
| 4,604,509 | A | 8/1986 | Clancy et al. | |
| 4,755,645 | A | 7/1988 | Naoki et al. | |
| 5,203,448 | A | 4/1993 | Osada et al. | |
| 5,256,843 | A | 10/1993 | Chiba et al. | |
| 5,278,374 | A | 1/1994 | Takagi et al. | |
| 5,401,926 | A | 3/1995 | Aoyama et al. | |
| 5,967,298 | A | 10/1999 | Watanabe et al. | |
| 6,153,844 | A | 11/2000 | Hyono et al. | |
| 6,649,821 | B2 * | 11/2003 | Inoue | G10C 3/12 84/423 R |
| 7,166,813 | B2 | 1/2007 | Soma et al. | |
| 7,217,893 | B1 | 5/2007 | Huang et al. | |
| 7,952,043 | B2 | 5/2011 | Lin | |
| 2001/0011999 | A1 | 8/2001 | Mochizuki | |
| 2002/0065054 | A1 | 5/2002 | Humphreys et al. | |
| 2006/0000694 | A1 | 1/2006 | Nishino et al. | |
| 2006/0113178 | A1 | 6/2006 | Soma et al. | |
| 2009/0224948 | A1 | 9/2009 | Nishino et al. | |
| 2009/0277766 | A1 | 11/2009 | Fujitsuna | |
| 2010/0078301 | A1 | 4/2010 | Yeh | |
| 2011/0127152 | A1 | 6/2011 | Hu | |
| 2014/0339065 | A1 | 11/2014 | Ohtsuka et al. | |
| 2015/0170854 | A1 | 6/2015 | Nishino et al. | |
| 2015/0199023 | A1 | 7/2015 | Hu et al. | |

FOREIGN PATENT DOCUMENTS

| | | | |
|---|---|---|---|
| CN | 1716483 | A | 1/2006 |
| CN | 1747092 | A | 3/2006 |
| CN | 101297385 | A | 10/2008 |
| CN | 101770250 | A | 7/2010 |
| CN | 102044361 | | 5/2011 |
| CN | 104715953 | A | 6/2015 |
| JP | 64-65732 | | 3/1989 |
| JP | 3-57114 | | 3/1991 |
| JP | 4-272625 | | 9/1992 |
| JP | 04-301331 | | 10/1992 |
| JP | 5-66832 | | 9/1993 |
| JP | 5-234460 | | 9/1993 |
| JP | 5-342944 | | 12/1993 |
| JP | 6-103851 | | 4/1994 |
| JP | 7-226123 | | 8/1995 |
| JP | 9-27235 | | 1/1997 |
| JP | 9-213165 | | 8/1997 |
| JP | 11-3628 | | 1/1999 |
| JP | 11-339590 | | 12/1999 |
| JP | 2000-235820 | | 8/2000 |
| JP | 2001-202849 | | 7/2001 |
| JP | 2004-139752 | | 5/2004 |
| JP | 2006-156170 | | 6/2006 |
| JP | 2009-211930 | | 9/2009 |
| JP | 2011-249282 | | 12/2011 |
| JP | 2011-253685 | | 12/2011 |
| JP | 2013-254615 | | 12/2013 |
| TW | 200847211 | | 12/2008 |
| TW | M377636 | U1 | 4/2010 |
| TW | 201602862 | A | 1/2016 |
| WO | 2007/114631 | | 10/2007 |

OTHER PUBLICATIONS

Patent Abstracts of Japan, Publication No. 04-272625, published Sep. 29, 1992.
Espacenet Bibliographic data, Publication No. JPH0566832 (U), published Sep. 3, 1993.
Patent Abstracts of Japan, Publication No. 05-234460, published Sep. 10, 1993.
Patent Abstracts of Japan, Publication No. 05-342944, published Dec. 24, 1993.
Patent Abstracts of Japan, Publication No. 06-103851, published Apr. 15, 1994.
Patent Abstracts of Japan, Publication No. 07-226123, published Aug. 22, 1995.
Patent Abstracts of Japan, Publication No. 09-027235, published Jan. 28, 1997.
Patent Abstracts of Japan, Publication No. 09-213165, published Aug. 15, 1997.
Patent Abstracts of Japan, Publication No. 11-003628, published Jan. 6, 1999.
Patent Abstracts of Japan, Publication No. 11-339590, published Dec. 10, 1999.
Patent Abstracts of Japan, Publication No. 2000-235820, published Aug. 29, 2000.
Patent Abstracts of Japan, Publication No. 2001-202849, published Jul. 27, 2001.
Patent Abstracts of Japan, Publication No. 2009-211930, published Sep. 17, 2009.
Patent Abstracts of Japan, Publication No. 2011-249282, published Dec. 8, 2011.
Patent Abstracts of Japan, Publication No. 2011-253685, published Dec. 15, 2011.
Patent Abstracts of Japan, Publication No. 2013-254615, published Dec. 19, 2013.
Sipo English Patent Abstract, Publication No. 1716483 A, Published Jan. 4, 2006.
Sipo English Patent Abstract, Publication No. 1177133 A, Published Mar. 25, 1998.
Espacenet English Abstract, Publication No. 1747092 A, Published Mar. 15, 2006.
Sipo English Patent Abstract, Publication No. 1604251 A, Published Apr. 6, 2006.
Chinese Office Action dated Jul. 20, 2016 in corresponding Chinese Patent Application No. 201410767031.X.
English translation of Japanese Reference No. 2006-079925, published Mar. 23, 2016.
J-PlatPat English Patent Abstract, Publication No. 2006-079925, Published Mar. 23, 2006.
Office Action for U.S. Appl. No. 14/558,794, dated Jan. 22, 2016.
Office Action for U.S. Appl. No. 14/558,794, dated Jun. 15, 2016.
Office Action for U.S. Appl. No. 14/558,794, dated Sep. 22, 2016.
Office Action for U.S. Appl. No. 14/558,794, dated Feb. 8, 2017.
U.S. Appl. No. 14/558,794, filed Dec. 3, 2014, Takeshi Nishino et al., Fujitsu Component Limited.
Office Action for corresponding Japanese Patent Application No. 2014-138828, dated Jan. 23, 2018.
J-Plat Pat English Abstract for Japanese Patent Application Publication No. 64-065732, published Mar. 13, 1989.

(56) References Cited

OTHER PUBLICATIONS

J-Plat Pat English Abstract for Japanese Patent Application Publication No. 2006-156170, published Jun. 15, 2006.
J-Plat Pat English Abstract for Japanese Patent Application Publication No. 04-301331, published Oct. 23, 1992.
Jun. 20, 2017 Notice of Allowance in parent U.S. Appl. No. 14/558,794 (now U.S. Pat. No. 9,741,507).
Chinese Office Action in Application No. 201710424845.7 dated Jun. 5, 2018.
Espacenet English Abstract for Chinese Publication No. 102044361, Published May 4, 2011.
Oct. 5, 2018 USPTO Action in co-pending U.S. Appl. No. 15/886,253.
Espacenet English abstract for Chinese Patent Publication No. 101297385 A, published Oct. 29, 2008.
Espacenet English abstract for Taiwanese Patent Publication No. 200847211, published Dec. 1, 2008.
Espacenet English abstract for Taiwanese Patent Publication No. 201602862 A, published Jan. 16, 2016.
Espacenet English abstract for Taiwanese Utility Model No. M377636U1, published Apr. 1, 2010.
Espacenet English abstract for Chinese Patent Publication No. 101770250 A, published Jul. 7, 2010.
Taiwanese Office Action dated Sep. 13, 2018 in corresponding Taiwanese Patent Application No. 107103377.
Japanese Platform for Patent Information English abstract for Japanese Patent Publication No. 2004-139752, published May 13, 2004.
Chinese Office Action dated Jan. 25, 2019 in corresponding Chinese Patent Application No. 201710424845.7.
Espacenet English abstract for Chinese Patent Publication No. 104715953 A, published Jun. 17, 2015.
Chinese Office Action dated Mar. 4, 2019 in corresponding Chinese Patent Application No. 201810202347.2.

* cited by examiner

REACTION FORCE GENERATING MEMBER FOR A KEY SWITCH DEVICE

CROSS-REFERENCE TO RELATED APPLICATION

This application is a divisional patent application of U.S. patent application Ser. No. 14/558,794 filed on Dec. 3, 2014, now U.S. Pat. No. 9,741,507, which is based upon and claims the benefit of priority of the prior Japanese Patent Application No. 2013-257706 filed on Dec. 13, 2013 and the prior Japanese Patent Application No. 2014-138828 filed on Jul. 4, 2014, the entire contents of which are incorporated herein by reference.

FIELD

A certain aspect of the embodiments is related to a key switch and a keyboard.

BACKGROUND

Conventionally, there has been known a key switch device including, between a membrane sheet and a key top, a cup rubber that gives a reaction force according to elastic deformation to the key top, and a coil spring that depresses a contact of the membrane sheet when the key top is depressed (see Japanese Laid-open Patent Publication No. 2011-253685 and Japanese Laid-open Patent Publication No. 2009-211930).

Moreover, there has been conventionally known a key switch device including a slider that is provided integrally with a key top, and a contact depression member that is provided so as to be able to relatively move against the slider. When the key top is operated, a depression force by a weight of a contact depression member, which is independent of the operation force (i.e. a force depressing the key top), is applied to a membrane switch (see Japanese Laid-open Patent Publication No. 2011-249282).

SUMMARY

According to an aspect of the present invention, there is provided a key switch device including: an operation member to be depressed; a switch disposed below the operation member; a reaction force generating member that is provided between the operation member and the switch, performs elastic buckling deformation by depression of the operation member, gives a reaction force according to the elastic buckling deformation to the operation member; and a depression member that is provided between the operation member and the switch, and depresses the switch; wherein the reaction force generating member includes a supporter that supports the depression member.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the key switch of Japanese Laid-open Patent Publication No. 2011-249282, the operation force increases until a load which acts on a dome rubber reaches a buckling load of the dome rubber. When the load which acts on the dome rubber reaches the buckling load of the dome rubber, the operation force decreases gradually with the increase in a keystroke. Then, the contact is turned on in the process in which the operation force is decreasing. Therefore, an operator gets a feeling of a click by acquiring a peak (maximum) operation force by the buckling deformation of the dome rubber. Since the contact is turned on in the process in which the operation force is decreasing, an operation feeling corresponds to a depression operation of the contact well.

However, the key switch device of Japanese Laid-open Patent Publication Nos. 2011-253685, 2009-211930 and 2011-249282 includes, between the membrane sheet and the key top, a stem or a slider fixed to the back side of the key top, and a housing that elevatingly guides and supports the key top via the stem or the slider. Therefore, there is a problem that reducing the thickness of the key switch device is difficult.

A description will now be given of embodiments of the present invention with reference to the drawings.

Figure 1A:
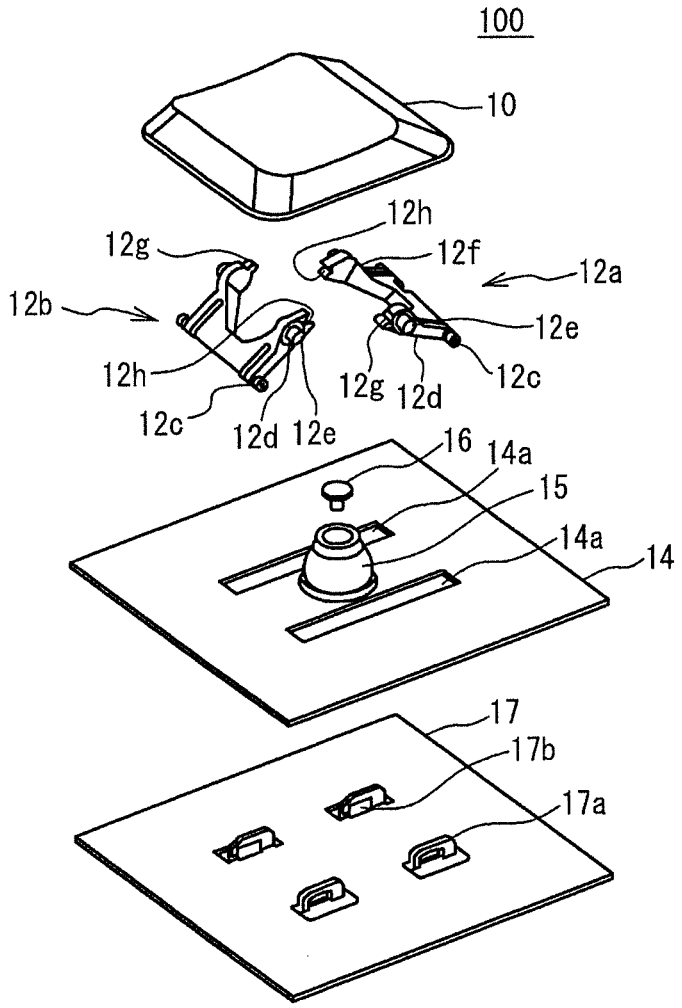
FIG. 1A is an exploded perspective view illustrating a key switch device according to a present embodiment.
Figure 1B:
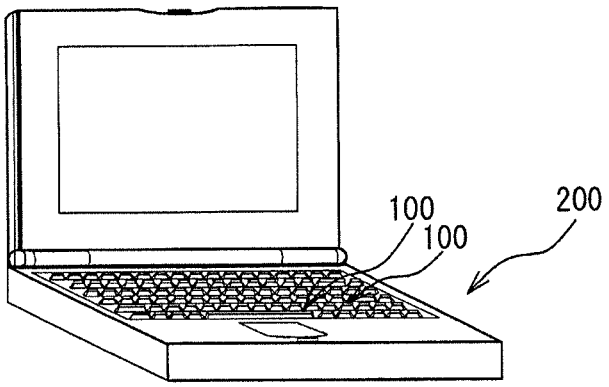
FIG. 1B is a diagram illustrating a computer including a keyboard on which a plurality of key switch devices are arranged.
Figure 2A:
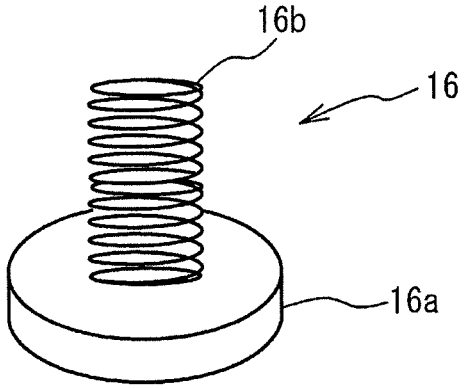
FIG. 2A is a diagram illustrating the configuration of a contact depression member.
Figure 2B:
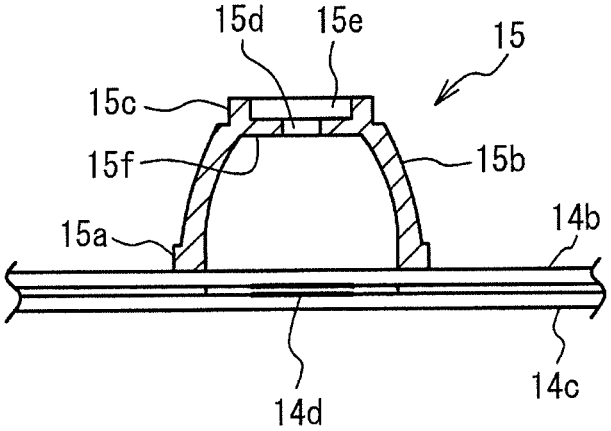
FIG. 2B is a cross-section diagram of a dome rubber.
Figure 3:
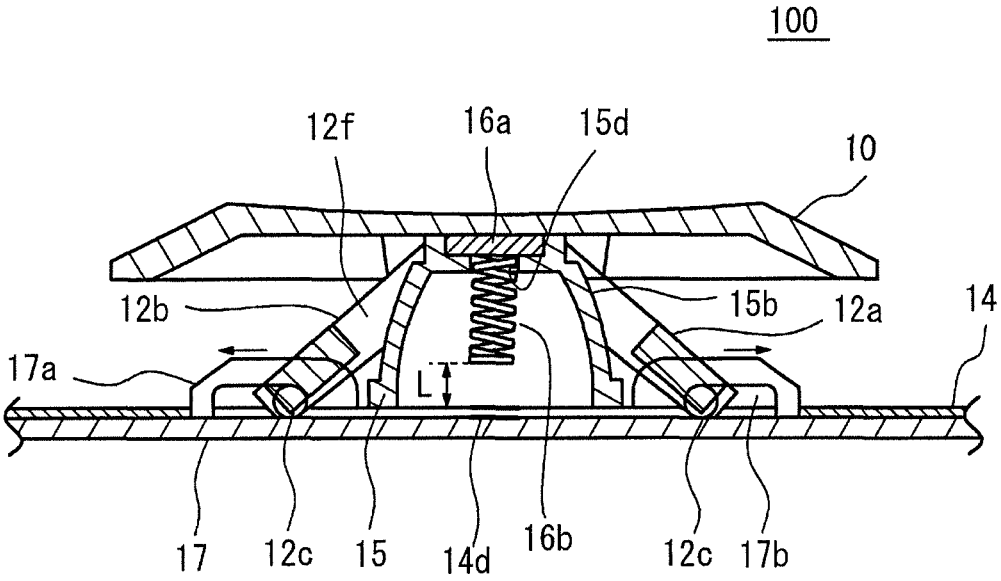
FIG. 3 is a cross-section diagram of a key switch device of FIG. 1A.

FIG. 1A is an exploded perspective view illustrating a key switch device according to a present embodiment. FIG. 1B is a diagram illustrating a computer including a keyboard on which a plurality of key switch devices are arranged. FIG. 2A is a diagram illustrating the configuration of a contact depression member. FIG. 2B is a cross-section diagram of a dome rubber. FIG. 3 is a cross-section diagram of a key switch device of FIG. 1A.

A key switch device 100 includes a key top 10, two gear links 12*a* and 12*b* as link members, a membrane sheet 14, a contact depression member 16 and a support panel 17, as illustrated in FIG. 1A. On a keyboard 200, a plurality of key switch devices 100 are arranged, as illustrated in FIG. 1B. Here, in the keyboard 200 of FIG. 1B, the single membrane sheet 14 and the single support panel 17 corresponding to the plurality of key switch devices 100 are used.

The membrane sheet 14 includes a pair of sheet substrates 14*b* and 14*c*, and a pair of contacts 14*d* functioning as a switch, as illustrated in FIG. 2B. The sheet substrates 14*b* and 14*c* are separated by a given distance, and unillustrated spacers are provided therebetween. The pair of contacts 14*d* are formed at positions of the sheet substrates 14*b* and 14*c* on which the spacers are not provided, so as to be opposite to each other, respectively. A dome rubber 15 as a reaction force generating member is formed on the membrane sheet 14.

The dome rubber 15 is a dome-shaped member composed of a rubber material by integral molding. The dome rubber 15 includes a ring-shaped base unit 15*a*, a dome unit 15*b* which stands in the shape of the dome from the base unit 15*a*, and a cylinder unit 15*c* which extends upward from the dome unit 15*b*. The inside of the dome unit 15*b* is a space, and the dome unit 15*b* elastically deforms according to the depression force. The dome rubber 15 is fixed to the membrane sheet 14 by adhesion, or the like. An upper end of the dome rubber 15 contacts a rear surface of the key top 10. The cylinder unit 15*c* has a concave unit 15*e* (a supporter) that houses a contact depression member 16. A wall 15*f* is formed between the dome unit 15*b* and the cylinder unit 15*c*. A through hole 15*d* which passes a coil spring of the contact depression member 16 is formed at the center of the wall 15*f*.

The contact depression member 16 is composed of a base member 16*a* and a coil spring 16*b*, as illustrated in FIG. 2A. The base member 16*a* is composed of a plate-shaped mold, a sheet metal, a resin, or the like. An end of the coil spring 16*b* is vertically fixed to the base member 16*a*. Another end of the coil spring 16*b* extends vertically upward from the base member 16*a*. The base member 16*a* is housed in the concave unit 15*e*, and the coil spring 16*b* projects inside the dome unit 15*b* via the through hole 15*d*, as illustrated in FIG. 3. The contact depression member 16 is attached from above the dome rubber 15. Since the base member 16*a* is sandwiched between the key top 10 and the wall 15*f*, the contact depression member 16 is fixed and does not separate from the dome rubber 15.

The support panel 17 is disposed under the key top 10 and the membrane sheet 14 is disposed between the key top 10 and the support panel 17, as illustrated in FIG. 1A. An upper surface of the support panel 17 is opposite to a lower surface of the membrane sheet 14. The support panel 17 includes four regulation units 17*a* that regulate the movement in a vertical direction of shafts 12*c* of the gear links 12*a* and 12*b* mentioned later. Each of the regulation units 17*a* is vertically formed to the support panel 17, and includes an approximately rectangle hole 17*b* into which the shaft 12*c* moving in a horizontal direction is inserted, as illustrated in FIG. 3. A part of the upper surface and the regulation units 17*a* are exposed from holes 14*a* provided in the membrane sheet 14.

Projections 12*e* are provided on apical portions 12*d* of the gear links 12*a* and 12*b* and are rotatably fixed to the rear surface of the key top 10, as illustrated in FIG. 1A. The shafts 12*c* are formed in the rear ends of the gear links 12*a* and 12*b*, and are inserted into holes 17*b* of the regulation units 17*a*. Thereby, the gear links 12*a* and 12*b* are fixed to the support panel 17 so as to be movable in a direction of an arrow of FIG. 3.

A first tooth 12*g* is provided on one of the apical portions 12*d* of the gear link 12*a* (i.e., the apical portion 12*d* of a front side in FIG. 1A), and a second tooth 12*h* is provided on another one of the apical portions 12*d* (i.e., the apical portion 12*d* of a back side in FIG. 1A). The first tooth 12*g* and the second tooth 12*h* are provided on the gear link 12*b*. The first tooth 12*g* of the gear link 12*a* engages with the second tooth 12*h* of the gear link 12*b*, and the second tooth 12*h* of the gear link 12*a* engages with the first tooth 12*g* of the gear link 12*b*. Thus, the pair of gear links 12*a* and 12*b* are coupled at the apical portions 12*d*, and can operate simultaneously with each other. Arm units 12*f* extend from the apical portions 12*d* toward the shafts 12*c*.

When the key top 10 is not depressed (at the time of un-depressing), the two gear links 12*a* and 12*b* are constructed in the shape of a reverse V-character, and support the key top 10. When the key top 10 is depressed with an operator's finger (at the time of depression), for example, the rear surface of the key top 10 depresses the dome rubber 15. Thereby, the dome rubber 15 performs buckling deformation, the coil spring 16*b* depresses the membrane sheet 14 and the contact 14*d* is turned on. When the finger is lifted from the key top 10, the key top 10 is pushed up upwards by the elastic force in an upper direction of the dome rubber 15. The rear ends of the gear links 12*a* and 12*b* are slid in the horizontal direction with depression of the key top 10, as indicated by arrows of FIG. 3. Then, the arm units 12*f* move downward. Thus, the gear links 12*a* and 12*b* guide the key top 10 in the vertical direction while keeping the key top 10 horizontally.

Figure 4:
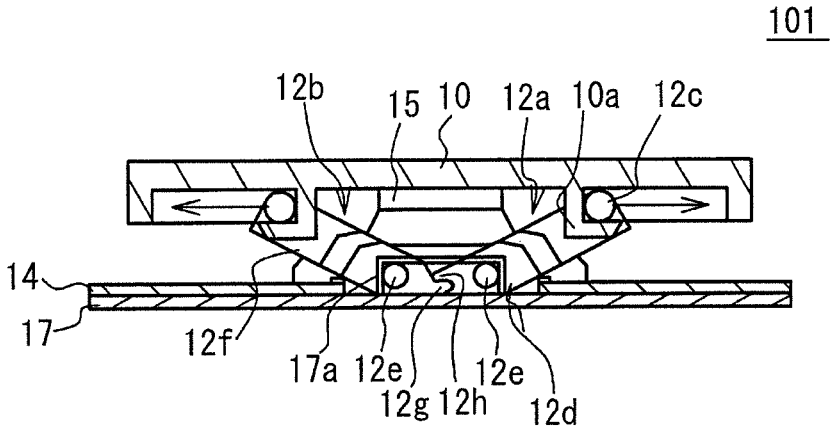
FIG. 4 is a cross-section diagram of a key switch device according to a first variation example.

In FIGS. 1A and 3, the two gear links 12*a* and 12*b* are constructed in the shape of a reverse V-character, and support the key top 10. However, the two gear links 12*a* and 12*b* may be constructed in the shape of a V-character, as illustrated in FIG. 4. FIG. 4 is a cross-section diagram of a key switch device 101 according to a first variation example. Although the contact depression member 16 is not illustrated in FIG. 4, the contact depression member 16 is housed in the concave unit 15*e* of the dome rubber 15 as with FIG. 3.

In FIG. 4, hooks 10*a* project from the rear surface of the key top 10. The shafts 12*c* are provided on apical portions (i.e., apical portions of sides of the key top 10) opposite to the apical portions 12*d*. The shafts 12*c* engage with the hooks 10*a*, so that the key top 10 and the gear link 12*a* are coupled and the key top 10 and the gear link 12*b* are coupled, respectively. End faces toward the outside of the key top 10 in the hooks 10*a* are opened. In this case, two regulation units 17*a* are formed on the support panel 17, and the two projections 12*e* which are formed on the apical portions 12*d* of the gear links 12*a* and 12*b*, respectively, are inserted into each of the regulation units 17*a*.

When the key top 10 is not depressed (at the time of un-depressing) as illustrated in FIG. 4, the two gear links 12*a* and 12*b* are constructed in the shape of a V-character, and support the key top 10. When the key top 10 is depressed with an operators finger (at the time of depression), for example, the rear surface of the key top 10 depresses the dome rubber 15. Thereby, the dome rubber 15 performs buckling deformation, the coil spring 16*b* depresses the membrane sheet 14 and the contact 14*d* is turned on. When the finger is lifted from the key top 10, the key top 10 is pushed upwards by the elastic force in an upper direction of the dome rubber 15. The shafts 12*c* of the gear links 12*a* and 12*b* are slid in the horizontal direction with depression of the key top 10, as indicated by arrows of FIG. 4. Then, the arm units 12*f* move downward. Thus, the gear links 12*a* and 12*b* guide the key top 10 in the vertical direction while keeping the key top 10 horizontally.

Figure 5A:
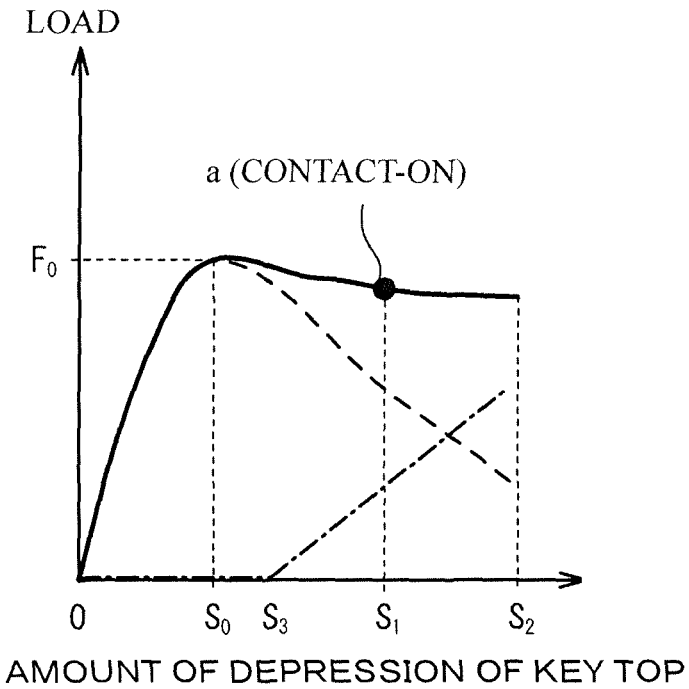
FIG. 5A is a diagram illustrating a load displacement characteristic of the key switch device according to the present embodiment.
Figure 5B:
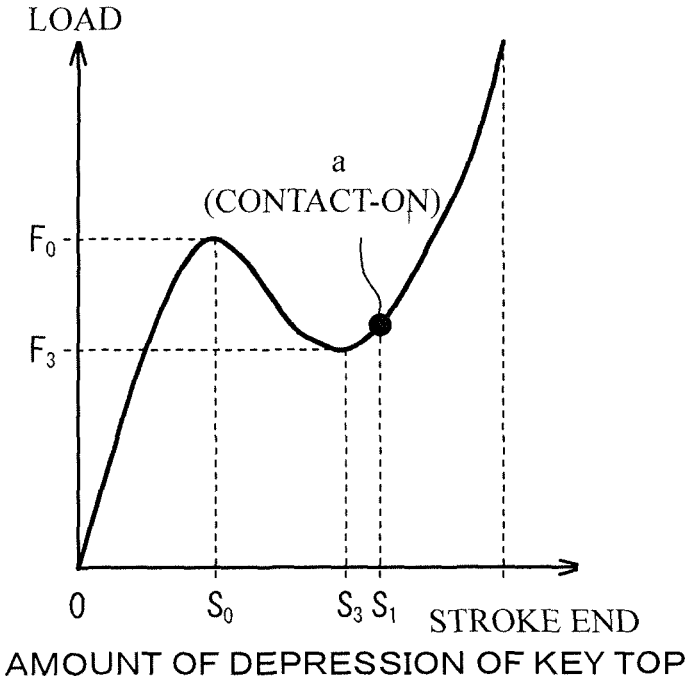
FIG. 5B is a diagram illustrating a load displacement characteristic of the key switch device according to a comparative example.

Hereinafter, a description will be given of a relationship between a stroke S of the key top 10 (i.e., an amount of depression) and a load (i.e., a depression force) F. FIG. 5A is a diagram illustrating a load displacement characteristic of the key switch device 100 according to the present embodiment. FIG. 5B is a diagram illustrating a load displacement characteristic of the key switch device according to a comparative example. Here, in FIGS. 5A and 5B, the stroke S is set to a horizontal axis, the load F is set to a vertical axis, and a point "a" of contact-ON is illustrated additionally.

In FIG. 5A, a dotted line indicates the load displacement characteristic of the dome rubber 15, and an alternate long and short dash line indicates the load displacement characteristic of the contact depression member 16 (specifically, the coil spring 16*b*), and a solid line indicates a characteristic acquired by combining the load displacement characteristics of the dome rubber 15 and the contact depression member 16. When the load F of the key top 10 increases from 0, the stroke S also increases from 0 with the increase in the load F, as illustrated in FIG. 5A. At this time, the dome rubber 15 performs the elastic deformation, and the reaction force from the dome rubber 15 acts on the key top 10. The load displacement characteristic of the key switch device 100 when the load F is from 0 to $F_0$ is equal to the load displacement characteristic of the dome rubber 15 itself. The load F rises until the load which acts on the dome rubber 15 reaches a buckling load (i.e., the load $F_0$) of the dome rubber 15. When the load which acts on the dome rubber 15 reaches the buckling load, subsequently the load F decreases gently with the increase in the stroke S. A peak load $F_0$ is obtained by the elastic buckling deformation of the dome rubber 15, and hence the operator can get a particular click feeling in a key touch operation.

In this case, a stroke $S_3$ corresponds to an initial length L3 between a lower end of the contact depression member 16 (i.e., a lower end of the coil spring 16*b*) and the membrane sheet 14 (see FIG. 3). This length L can be set by adjusting the length of the coil spring 16*b*. The stroke $S_3$ can be changed by adjusting the length L, and hence the stroke $S_1$ of the key top 10 at the time of contact-ON can be changed. That is, by adjusting the length L, the stroke $S_1$ of the key top 10 at the time of contact-ON can be set arbitrarily.

In the present embodiment, the stroke $S_1$ is set to a value that is larger than a stroke $S_0$ in which the peak load $F_0$ is generated, and that is smaller than an end stroke $S_2$ (for example, a middle value between the strokes $S_0$ and $S_2$). Thereby, since the contact 14*d* is turned on in a reduction domain of the load F after the operator gets the click feeling, an operator's operation feeling corresponds to the ON-operation of the contact 14*d* well, and hence the operability of the key switch improves.

Figure 6:
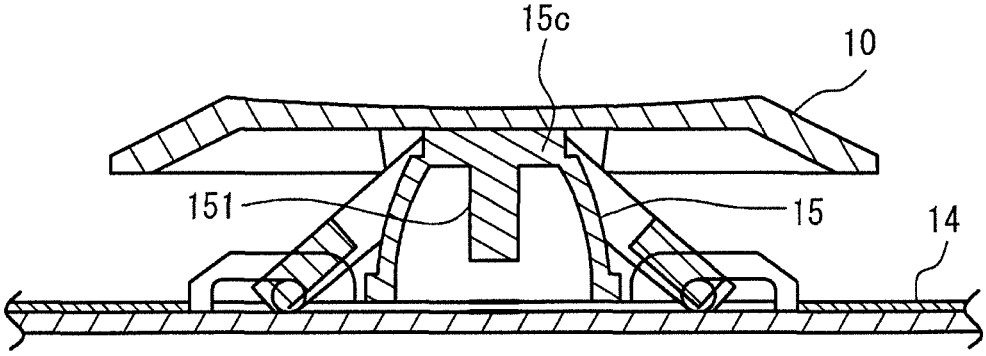
FIG. 6 is a cross-section diagram of a key switch device according to the comparative example.

FIG. 5B illustrates the load displacement characteristic of the key switch device when a projection is provided downward from the cylinder unit 15*c* of the dome rubber 15. Here, the dome rubber 15 in which the cylinder unit 15*c* is closed is used, and a projection 151 is provided downward from the cylinder unit 15*c*, as illustrated in FIG. 6. FIG. 6 is a cross-section diagram of the key switch device according to the comparative example. In this case, when the load F of the key top 10 increases from 0 as illustrated in FIG. 5B, the stroke S also increases from 0 with the increment in the load F. When the load which acts on the dome rubber 15 reaches the buckling load, the load F becomes a maximum value $F_0$. Then, the load decreases. When the projection 151 contacts the membrane sheet 14 at the stroke $S_3$, the load F rises again.

At this time, when a given depression force is added to the contact 14*d* after the projection 151 contacts the membrane sheet 14, the contact 14*d* of the membrane sheet 14 is turned on. Therefore, the stroke $S_1$ at the time of contact-ON is larger than the stroke $S_3$ in which the load F becomes a minimum value $F_3$. Accordingly, in order to turn on the contact 14*d*, the operator needs to do key operation until the peak load $F_0$ is exceeded and the load decreases and again increases. However, the operator usually judges that the contact is turned on in the reduction domain of the load F after the peak load $F_0$ is exceeded. Therefore, if the operator needs to do the key operation in the increase domain of the load F, deviation occurs between the operation feeling and the contact depression operation, and hence the operator has a sense of discomfort. With respect to this, in the present embodiment, the contact 14*d* can be turned on in the reduction domain of the load F, so that the operation feeling and the contact depression operation can be made to correspond well, and the sense of discomfort does not occur.

As described above, each of the key switch device 100 of FIG. 3 and the key switch device 101 of FIG. 4 includes: the dome rubber 15 that gives the reaction force according to the elastic buckling deformation to the key top 10; and the contact depression member 16 that is provided between the key top 10 and the contact 14*d*, and depresses the contact 14*d* against the reaction force from the dome rubber 15. Then, the dome rubber 15 includes the concave unit 15*e* housing the contact depression member 16, and the contact depression member 16 is housed in the concave unit 15*e*. Therefore, the operation feeling can correspond to the contact depression operation well, and the thickness (i.e., height) of each of the key switch devices 100 and 101 can be reduced. Especially, the stem or slider fixed to the rear surface of the key top, and the housing that elevatingly guides and supports the key top, which were used conventionally, become unnecessary. Therefore, the thickness of each of the key switch devices 100 and 101 can be reduced.

Figure 7:
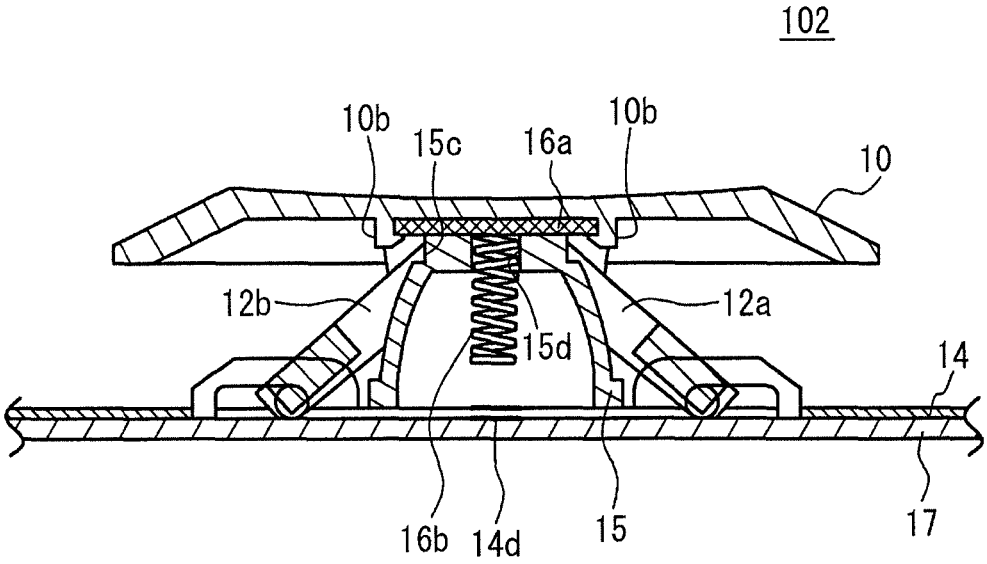
FIG. 7 is a cross-section diagram of a key switch device according to a second variation example.

FIG. 7 is a cross-section diagram of a key switch device 102 according to a second variation example.

Hook units 10*b* are formed on the rear surface of the key top 10, as illustrated in FIG. 7. The base member 16*a* of the contact depression member 16 is fixed to the rear surface of the key top 10 by the hook units 10*b*. The through hole 15*d* for passing the coil spring 16*b* is formed on the cylinder unit 15*c* of the dome rubber 15. The concave unit 15*e* housing the contact depression member 16 is not formed on the cylinder unit 15*c* of the dome rubber 15, unlike FIG. 3. However, the concave unit 15*e* may be formed on the cylinder unit 15*c* of the dome rubber 15. Other elements are the same as corresponding elements of FIG. 3. The key switch device of FIG. 7 also has the depression characteristic of FIG. 5A.

As with the key switch devices 100 and 101, the key switch device 102 according to the second variation example also can make the operation feeling and the contact depression operation correspond well, and can reduce the thickness (i.e., height) of the key switch device 102.

Figure 8:
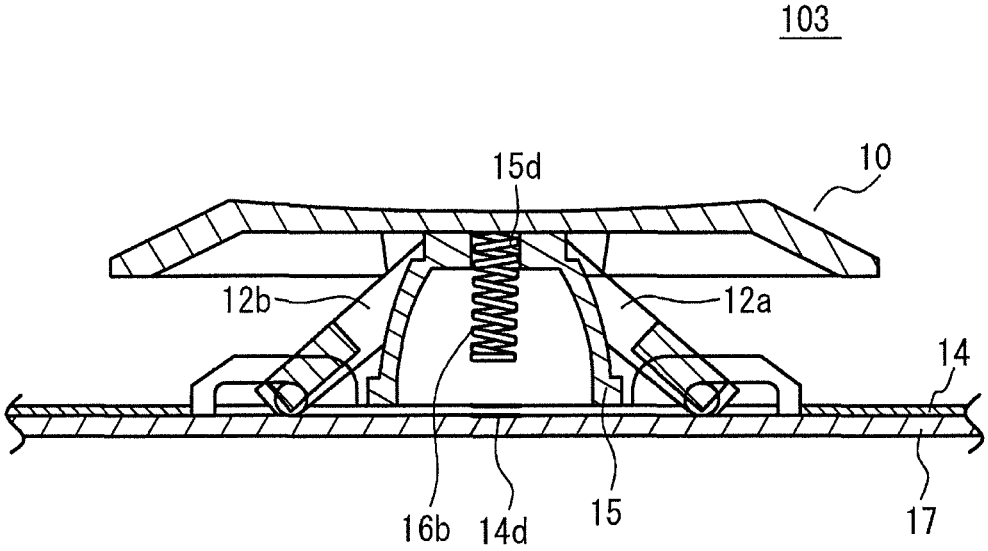
FIG. 8 is a cross-section diagram of a key switch device according to a third variation example.

FIG. 8 is a cross-section diagram of a key switch device 103 according to a third variation example.

In FIG. 8, one end of the coil spring 16*b* is integrally formed with the rear surface of the key top 10. Another end of the coil spring 16*b* extends vertically downward from the rear surface of the key top 10 via the through hole 15*d*. Other elements are the same as corresponding elements of FIG. 7. The key switch device of FIG. 8 also has the depression characteristic of FIG. 5A.

According to the key switch device 103 of the third variation example, since the one end of the coil spring 16*b* is integrally formed with the rear surface of the key top 10, the base member 16*a* is unnecessary. Therefore, the thickness (i.e., height) of the key switch device 103 can be further reduced, compared with the key switch devices 100 to 102.

Figure 9:
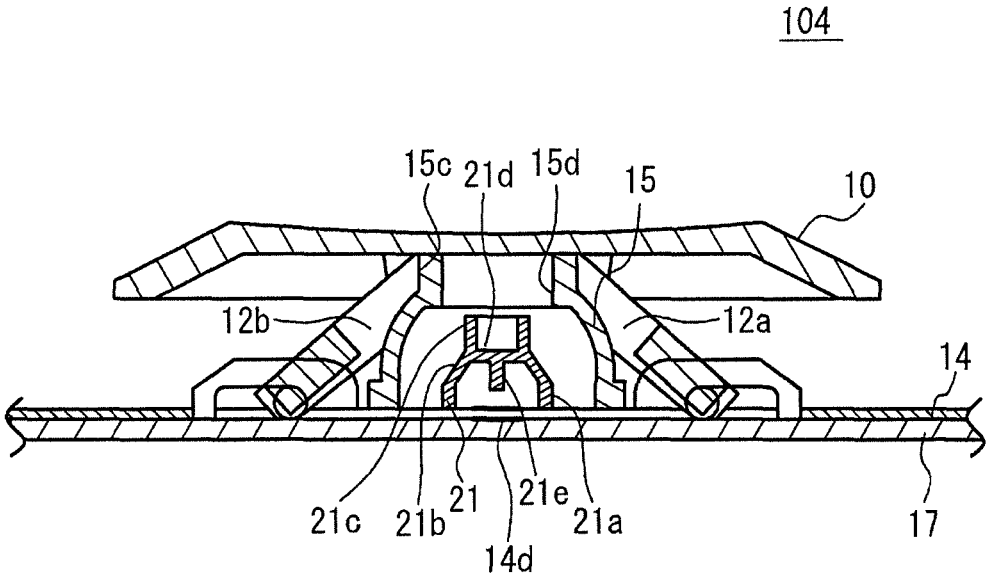
FIG. 9 is a cross-section diagram of a key switch device according to a fourth variation example.

FIG. 9 is a cross-section diagram of a key switch device 104 according to a fourth variation example. In FIG. 9, a contact depression rubber 21 is used instead of the contact depression member 16.

The contact depression rubber 21 is a dome-shaped member composed of a rubber material by integral molding. The contact depression rubber 21 includes a ring-shaped base unit 21*a*, a dome unit 21*b* which stands in the shape of the dome from the base unit 21*a*, and a cylinder unit 21*c* which extends upward from the dome unit 21*b*. A wall 21*d* is formed between the dome unit 21*b* and the cylinder unit 21*c*. A projection 21*e* which depresses the contact 14*d* is formed at the center of the wall 21*d* toward the membrane sheet 14. The inside of the base unit 21*a* and the dome unit 21*b* is a space. The dome unit 21*b* deforms elastically by the depression force.

A through hole 15*d* which is larger in a bore diameter than the through hole 15*d* of FIGS. 7 and 8 is formed in the center of the cylinder unit 15*c* of the dome rubber 15. An inner circumference of the through hole 15*d* of FIG. 9 is larger than an outer circumference of the contact depression rubber 21 in a top surface view. The contact depression rubber 21 enters into the through hole 15*d* by depression of the key top 10.

The contact depression rubber 21 according to the fourth variation example is arranged inside the dome rubber, and has a linear load displacement characteristic as illustrated by the alternate long and short dash line of FIG. 5A at the time of depression. The linear load displacement characteristic is a characteristic indicating that the load F (i.e., the depression force) increases in proportion to the increase in the stroke (i.e., the amount of depression). As long as the load displacement characteristic indicates that the load increases according to the increase in the stroke, the load displacement characteristic need not necessarily be a linear characteristic. The contact depression rubber 21 is fixed on the membrane sheet 14 by adhesion, and the dome rubber 15 is fixed outside the contact depression rubber 21 on the membrane sheet 14 by adhesion. Thereby, at the time of beginning of depression of the key top 10, only the load displacement characteristic of the dome rubber 15 functions (see the dotted line of FIG. 5A), and from the middle of depression of the key top 10, the key top 10 depresses simultaneously the dome rubber 15 and the contact depression rubber 21. Therefore, the key switch device 104 can obtain a load displacement characteristic acquired by combining the load displacement characteristics of the dome rubber 15 and the contact depression rubber 21, as illustrated by the solid line of FIG. 5A.

According to the key switch device 104 of the fourth variation example, the dome rubber 15 is used, and the contact depression rubber 21 which is arranged inside the dome rubber 15 and has the projection 21*e* depressing the contact 14*d* is used instead of the contact depression member 16. Moreover, the upper surface of the dome rubber 15 is opened so that the upper end of the contact depression rubber 21 contacts the rear surface of the key top 10. Therefore, the operation feeling and the contact depression operation can be made to correspond well, and the thickness (i.e., height) of the key switch device 104 can be reduced.

Figure 10:
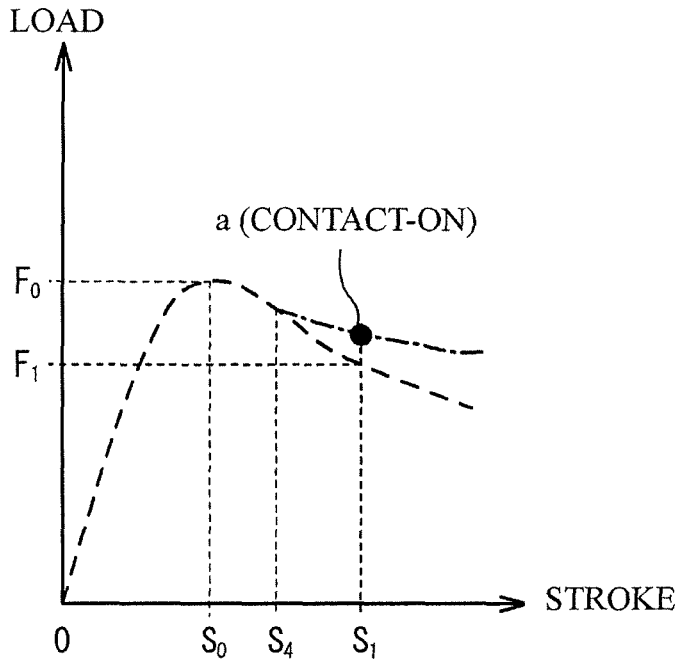
FIG. 10 is a diagram illustrating a load displacement characteristic of the key switch device according to the present embodiment.

FIG. 10 is a diagram illustrating a load displacement characteristic of the key switch device 100 according to the present embodiment. A dotted line indicates the load displacement characteristic of the dome rubber 15. An alternate long and short dash line indicates a combined load displacement characteristic of the dome rubber 15 and a contact depression member 12*i* mentioned later.

As described above, the key switch device 100 obtains the load displacement characteristic as indicated by the dotted line of FIG. 10 (an interval between the strokes 0 and $S_4$) and the alternate long and short dash line of FIG. 10 (an interval after the stroke $S_4$), i.e., as indicated by the solid line of FIG. 5A, by combining the load displacement characteristics of two members (i.e., the dome rubber 15, and the coil spring 16*b* or contact depression rubber 21).

By the way, when the peak load $F_0$ is exceeded, the load displacement characteristic of the dome rubber 15 decreases rapidly as illustrated by the dotted line of FIG. 10. Therefore, when the contact 14*d* can be turned on by the increase in load smaller than the reduction of the load displacement characteristic of the dome rubber 15 (see the alternate long and short dash line of FIG. 10), the key switch device 100 obtains the load displacement characteristic as illustrated by the solid line of FIG. 5A. In this case, since the contact 14*d* is turned on in the reduction domain of the load F after the operator gets the click feeling, the operator's operation feeling corresponds to the ON-operation of the contact 14*d* well, and hence the operability of the key switch improves.

Hereinafter, a description will be given of the configuration of the key switch device 100 that can turn on the contact 14*d* by the increase in load smaller than the reduction of the load displacement characteristic of the dome rubber 15.

Figure 11:
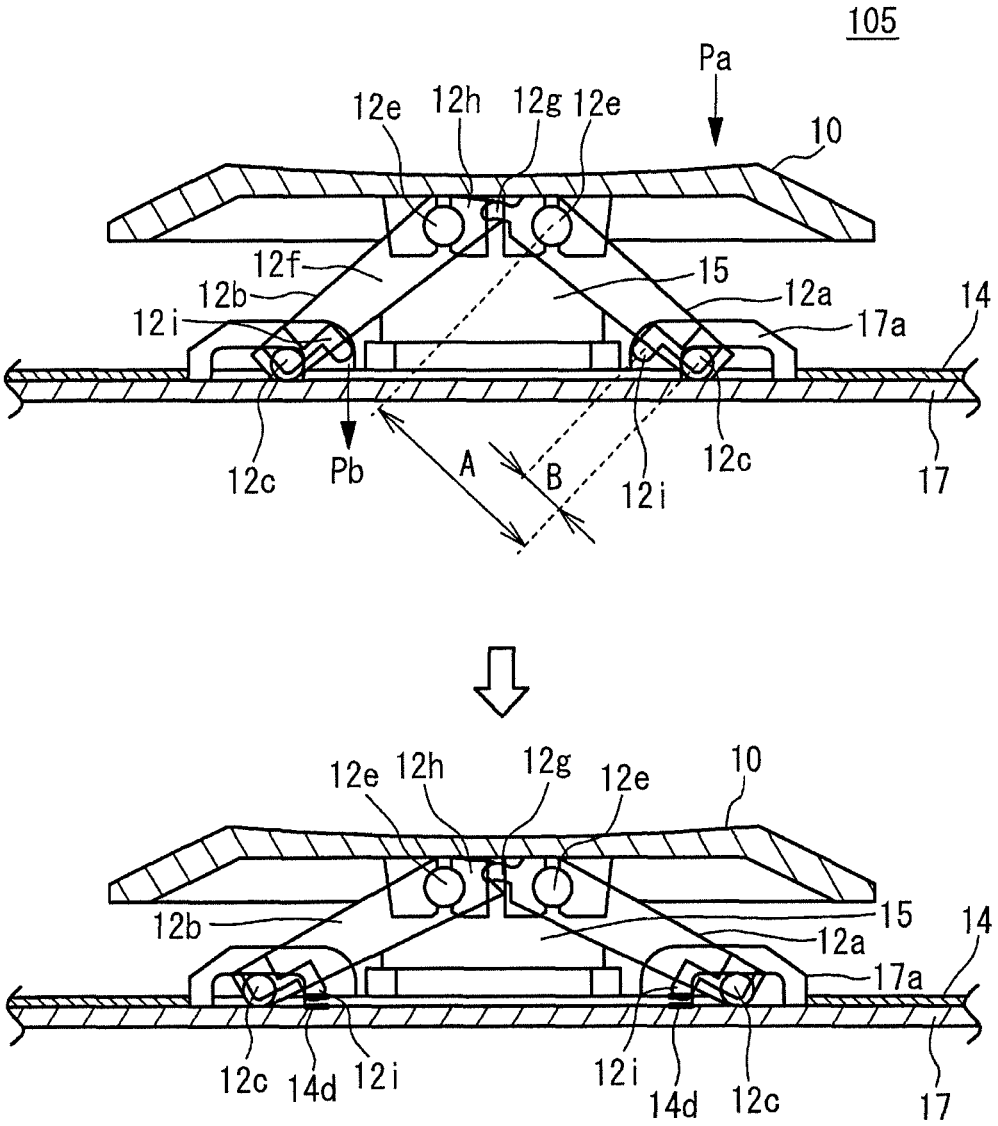
FIG. 11 is a cross-section diagram of a key switch device according to a fifth variation example.
Figure 12:
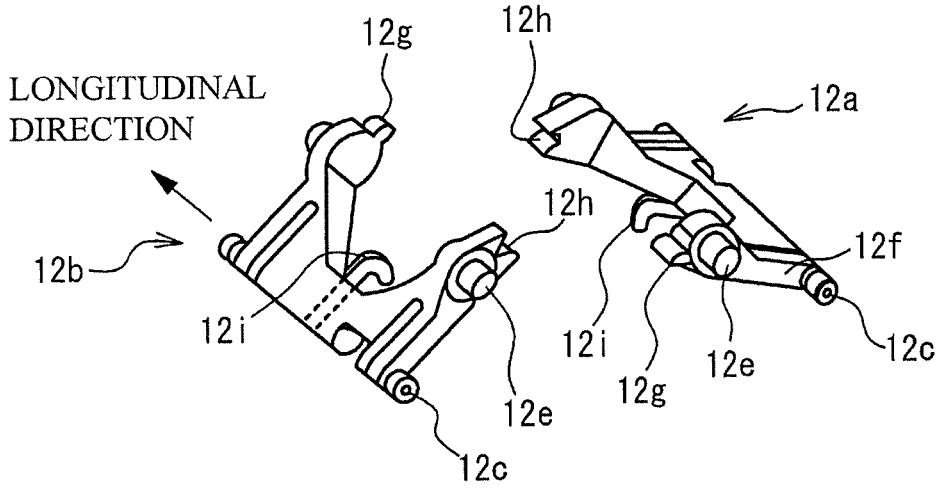
FIG. 12 is a diagram of a variation example of gear links.

FIG. 11 is a cross-section diagram of a key switch device 105 according to a fifth variation example. FIG. 12 is a diagram of a variation example of the gear links 12*a* and 12*b*.

A contact depression member 12*i* is integrally fixed to a center part of the rear end of each of the gear links 12*a* and 12*b*, as illustrated in FIGS. 11 and 12. The contact depression member 12*i* is formed in the shape of a crank. A front edge of the contact depression member 12*i* projects from an under side of the arm unit 12*f* of each of the gear links 12*a* and 12*b*. As illustrated in FIG. 11, the gear links 12*a* and 12*b* rotate so as to fall over horizontally by depression of the key top 10, each shaft 12*c* moves horizontally, and each contact depression member 12*i* depresses the contact 14*d*. Here, the contact depression member 12*i* has elasticity so as not to prohibit rotational operation of each of the gear links 12*a* and 12*b* after depression of the contact 14*d*.

In FIGS. 3 and 7 to 9, the contact 14*d* is arranged at a position opposite to the center of the key top 10. On the contrary, in FIG. 11, the contact 14*d* is arranged in the vicinity of the regulation units 17*a*.

By the way, at the time of depression of the key top 10 of FIG. 11, each projection 12*e* fixed to the key top 10 serves as a force point, and a half of all load is applied to one of the gear links. As illustrated in FIG. 11, a distance between the shaft 12*c* (i.e., a fulcrum) of the gear link 12*a* and the projection 12*e* (i.e., a force point) of the gear link 12*a* is indicated by "A", the front edge (i.e., an acting point) of the contact depression member 12*i* for turning on the contact 14*d* is arranged at a position separated by a distance B (B<A) from the fulcrum, and a depression load applied to the force point is indicated by "Pa". In this case, a load Pb which occurs in the acting point is expressed by "Pb=Pa×A/B", and becomes larger than the depression load applied to the force point.

Generally, in order to turn on the contact 14*d*, the load from a little gf (gram-force) to about 10 gf is needed. On the other hand, the peak load of key depression is generally set to about 50 gf. When a peak position is exceeded, the load required for key depression decreases. At the time of the peak load, the load of about 25 gf per gear link is applied to the force point of the gear link. The depression load Pa required in order to acquire at the acting point the load of 10 gf for turning on the contact 14*d* is calculated by "10 gf=Pa×A/B". For example, in the case of A/B=4, the depression load Pa is 2.5 gf. At this time, in the load displacement characteristic of the dome rubber 15 as illustrated in FIG. 10, when an amount of load descent from the peak load $F_0$ to the load $F_1$ corresponding to the contact-ON position "a" is set as 2.5 or more gf, the combined load displacement characteristic (see the alternate long and short dash line of FIG. 10) does not rise after the depression load reaches the peak load. Thereby, it is possible to acquire an ideal load displacement characteristic.

According to the key switch device 105 of the fifth variation example, the key switch device 105 includes the dome rubber 15 and the contact depression member 12*i*, and the contact depression member 12*i* is provided in the center part of the rear end of each of the gear links 12*a* and 12*b*. Therefore, the operation feeling and the contact depression operation can be made to correspond well, and the thickness (i.e., height) of the key switch device 105 can be reduced. Moreover, the contact 14*d* can be turned on by the increase in load smaller than the reduction of the load displacement characteristic of the dome rubber 15.

Figure 13:
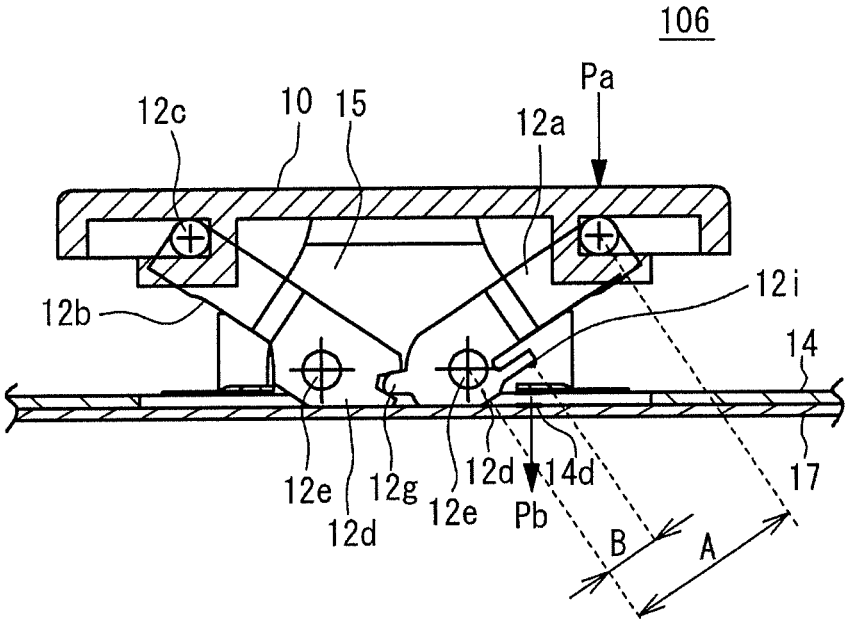
FIG. 13 is a cross-section diagram of a key switch device according to a sixth variation example.

FIG. 13 is a cross-section diagram of a key switch device 106 according to a sixth variation example. In FIG. 13, the regulation units 17*a* are omitted for convenience of explanation.

In FIG. 13, the two gear links 12*a* and 12*b* are constructed in the shape of a V-character, and support the key top 10. The contact depression member 12*i* is integrally formed with the apical portion 12*d*, and formed between the shaft 12*c* of the gear link 12*a* and the projection 12*e*. Here, the contact depression member 12*i* has elasticity so as not to prohibit rotational operation of each of the gear links 12*a* and 12*b* after depression of the contact 14*d*.

As illustrated in FIG. 13, a distance between the shaft 12*c* (i.e., a force point) of the gear link 12*a* and the projection 12*e* (i.e., a fulcrum) of the gear link 12*a* is indicated by "A", the front edge (i.e., an acting point) of the contact depression member 12*i* for turning on the contact 14*d* is arranged at a position separated by a distance B (B<A) from the fulcrum, and a depression load applied to the force point is indicated by "Pa". In this case, as with FIG. 11, a load Pb which occurs in the acting point is expressed by "Pb=Pa×A/B", and becomes larger than the depression load applied to the force point.

According to the key switch device 106 of the sixth variation example, the key switch device 106 includes the dome rubber 15 and the contact depression member 12*i*, and the contact depression member 12*i* is integrally formed with the apical portion 12*d*. Therefore, the operation feeling and the contact depression operation can be made to correspond well, and the thickness (i.e., height) of the key switch device 106 can be reduced. Moreover, the contact 14*d* can be turned on by the increase in load smaller than the reduction of the load displacement characteristic of the dome rubber 15.

Figure 14:
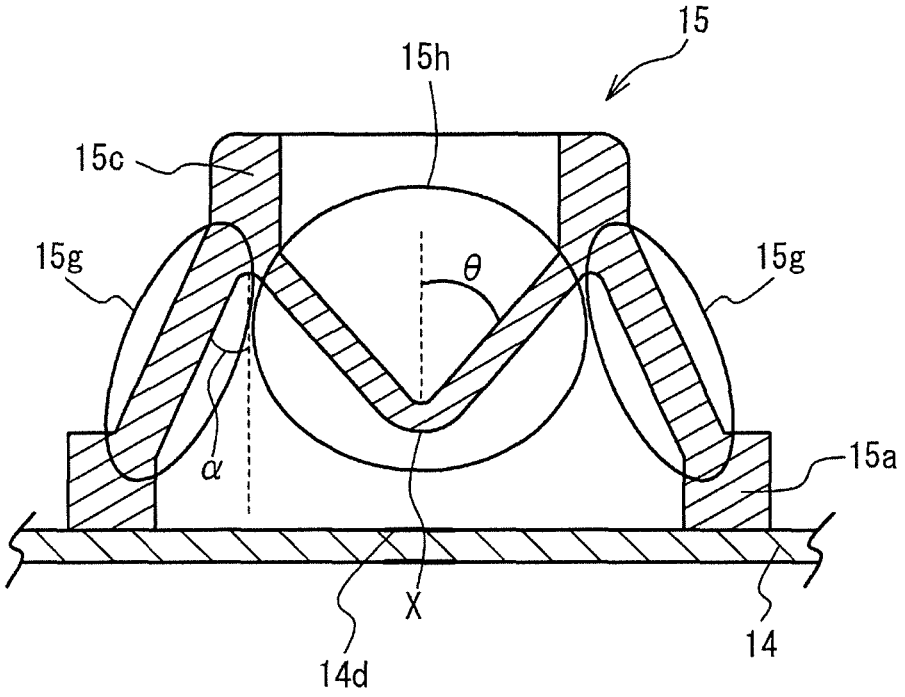
FIG. 14 is a cross-section diagram of a variation example of the dome rubber.

FIG. 14 is a cross-section diagram of a variation example of the dome rubber 15. In the above-mentioned key switch device 100, the member (i.e., the dome rubber 15) that generates the reaction force when the key top 10 is depressed, and the contact depression member 16 or 12*i* or contact depression rubber 21 that depresses the contact 14*d* are provided separately. That is, a reaction force generating member and the contact (i.e., the dome rubber 15) and the contact depression member are mutually separated. On the other hand, the dome rubber 15 of FIG. 14 alone has a function as the reaction force generating member, and a function as the contact depression member.

The dome rubber 15 of FIG. 14 is a dome-shaped member composed of a rubber material by integral molding. The dome rubber 15 includes a ring-shaped base unit 15*a*, an outer dome unit 15*g* that extends diagonally upward from the base unit 15*a*, the cylinder unit 15*c* that extends upward from the outer dome unit 15*q*, and an inner dome unit 15*h* that extends in a reverse conical shape from the cylinder unit 15*c*. The outer dome unit 15*g* functions as the reaction force generating member, and the inner dome unit 15*h* functions as the contact depression member. The outer dome unit 15*g* inclines from a vertical direction by an angle $\alpha$ ($\alpha$>45 degrees). A half apex angle $\theta$ of the inner dome unit 15*h* is 45 degrees or more. This is because the inner dome unit 15*h* does not perform buckling and the load displacement characteristic indicating that the load increases according to the increase in the stroke, such as the linear load displacement characteristic illustrated by the alternate long and short dash line of FIG. 5A, is acquired. When the inner dome unit 15*h* is a projection, for example, the projection performs the buckling by depression of the key top 10 and a desirable load displacement characteristic may not be acquired.

Until the key top 10 is depressed and an apex X of the inner dome unit 15*h* reaches the membrane sheet 14, the outer dome unit 15*g* performs the buckling modification. When the apex X of the inner dome unit 15*h* reaches the membrane sheet 14, the modification of the inner dome unit 15*h* is begun. Therefore, the outer dome unit 15*g* has the load displacement characteristic illustrated by the dotted line of FIG. 5A, and the inner dome unit 15*h* has the load displacement characteristic illustrated by the alternate long and short dash line of FIG. 5A. As a result, the dome rubber 15 of FIG. 14 alone has the load displacement characteristic illustrated by the solid line of FIG. 5A. In this case, an optimal load displacement characteristic can be realized without using additional parts.

Here, although the inner dome unit 15*h* is formed in the shape of a reverse cone, the shape of the inner dome unit 15*h* is not limited to this, and may be a reverse polygonal cone or a reverse truncated cone, for example. As long as a characteristic indicating that the load increases according to the increase in the stroke, such as the linear load displacement characteristic illustrated by the alternate long and short dash line of FIG. 5A, is acquired, the shape of the inner dome unit 15*h* is not limited.

According to the dome rubber 15 of FIG. 14, the dome rubber 15 alone includes the function as the reaction force generating member and the function as the contact depression member. Therefore, the operation feeling and the contact depression operation can be made to correspond well, and the thickness (i.e., height) of the key switch device can be reduced. Moreover, since the coil spring or the like become unnecessary, the manufacturing cost of the key switch device can be reduced.

Figure 15A:
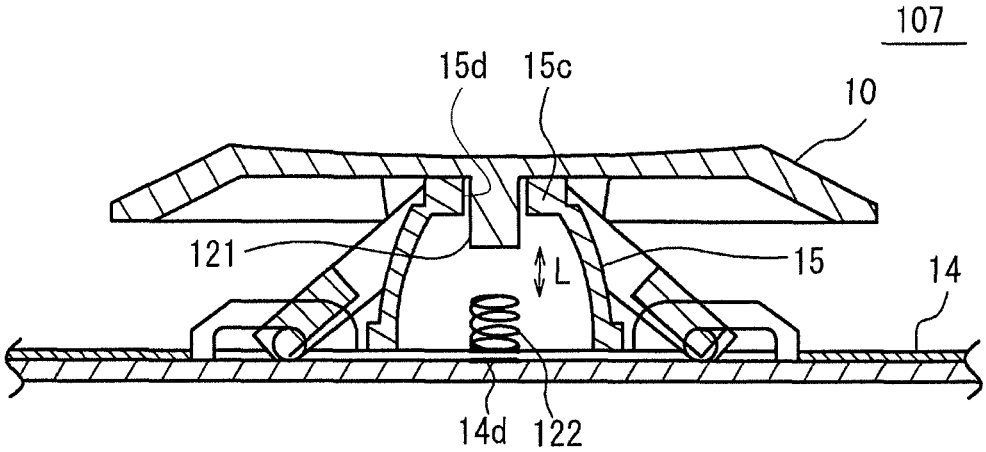
FIG. 15A is a cross-section diagram of a key switch device according to a seventh variation example.
Figure 15B:
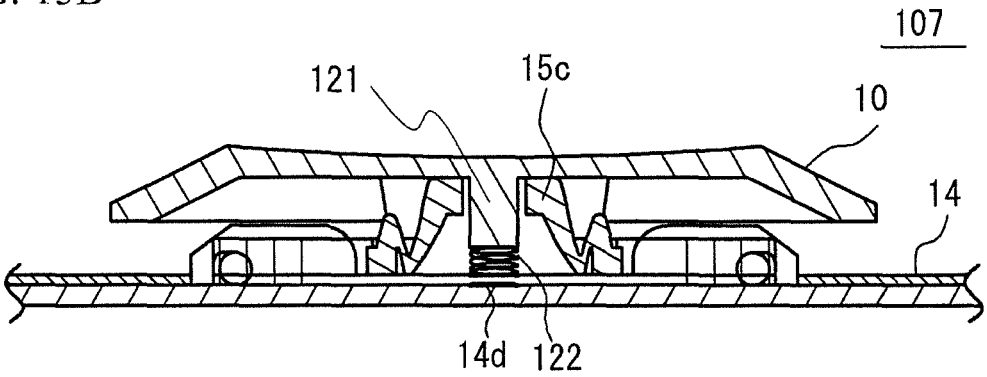
FIG. 15B is a cross-section diagram of the key switch device according to the seventh variation example at the time of depression of the key top.
Figure 15C:
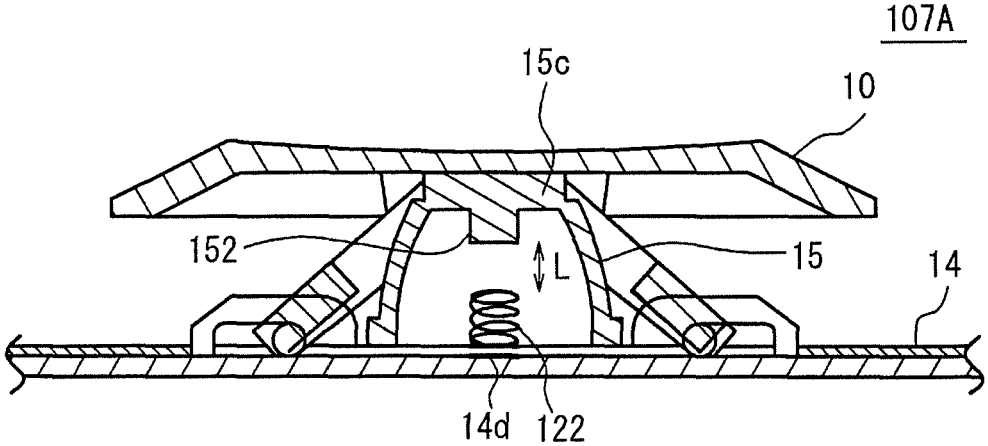
FIG. 15C is a cross-section diagram of a variation example of the key switch device of FIG. 15A.

FIG. 15A is a cross-section diagram of a key switch device 107 according to a seventh variation example. FIG. 15B is a cross-section diagram of the key switch device 107 according to the seventh variation example at the time of depression of the key top 10. FIG. 15C is a cross-section diagram of a variation example of the key switch device 107 of FIG. 15A.

A projection 121 extending downward is provided on the rear surface of the key top 10, as illustrated in FIG. 15A. A through hole 15*d* for passing the projection 121 is formed on the cylinder unit 15*c* of the dome rubber 15. Unlike FIG. 3, the concave unit 15*e* housing the contact depression member 16 is not formed on the cylinder unit 15*c* of the dome rubber 15. In FIG. 15A, a coil spring 122 is pasted and fixed on the contact 14*d* of the membrane sheet 14. The coil spring 122 has a same elastic characteristic as the coil spring 16*b* mentioned above. At the time of un-depressing of the key top 10, the projection 121 is separated from the coil spring 122 by a distance L, and is opposite to the coil spring 122, as illustrated in FIG. 15A. At the time of depression of the key top 10, the dome rubber 15 performs buckling modification, and the projection 121 contacts the coil spring 122, as illustrated in FIG. 15B. Moreover, when the key top 10 is depressed so that the coil spring 122 is compressed, the contact 14*d* is turned on. The key switch device 107 of FIG. 15A also has the depression characteristic of FIG. 5A. In this case, the dotted line of FIG. 5A indicates the load displacement characteristic of the dome rubber 15, the alternate long and short dash line indicates the load displacement characteristic of the coil spring 122 as the contact depression member, and the solid line indicates the characteristic acquired by combining the load displacement characteristics of the dome rubber 15 and the coil spring 122.

Although the projection 121 extending downward is provided on the rear surface of the key top 10 in FIG. 15A, in a key switch device 107A of FIG. 15C, a projection 152 extending downward is provided in the center of the cylinder unit 15*c* of the dome rubber 15. Here, the through hole 15*d* is not formed on the cylinder unit 15*c* of the dome rubber 15. Other elements of the key switch device 107A of FIG. 15C are the same as corresponding elements of the key switch device 107 of FIG. 15A. Therefore, the key switch device 107A of FIG. 15C also has the depression characteristic of FIG. 5A.

As with the key switch devices 100 and 101, the key switch devices 107 and 107A also can make the operation feeling and the contact depression operation correspond well, and the thickness (i.e., height) of the key switch devices 107 and 107A can be reduced. Moreover, in the key switch devices 107 and 107A according to seventh variation example, the coil spring 122 is mounted on the contact 14*d* of the membrane sheet 14, and hence it becomes easy to arrange the coil spring 122 in the center of the contact 14*d* of the membrane sheet 14. Thereby, an accuracy which depresses the center of the contact 14*d* can be improved, and fluctuation of an ON-load (i.e., a load required to turn on the contact 14*d*) by fluctuation of depression position of the contact 14*d* can be reduced.

Figure 16A:
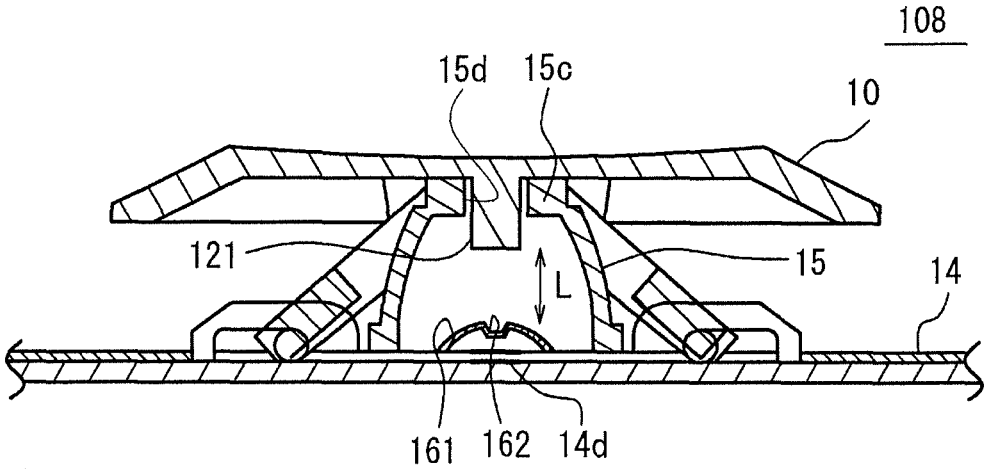
FIG. 16A is a cross-section diagram of a key switch device according to an eighth variation example.
Figure 16B:
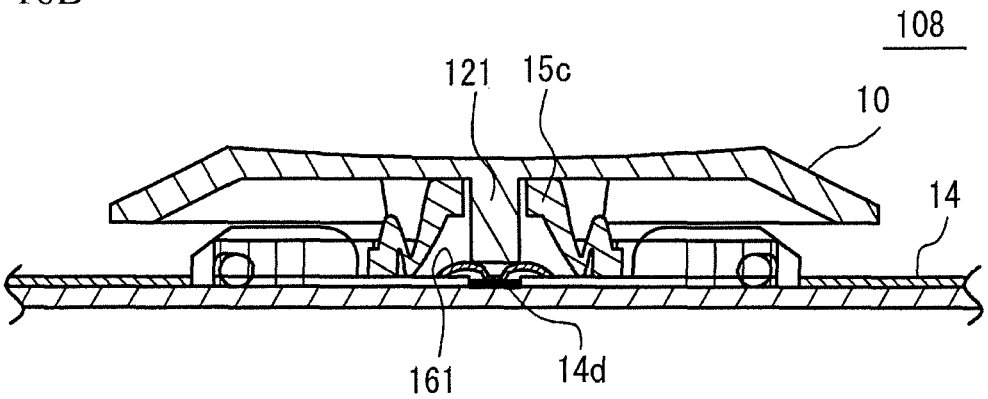
FIG. 16B is a cross-section diagram of the key switch device according to the eighth variation example at the time of depression of the key top.
Figure 16C:
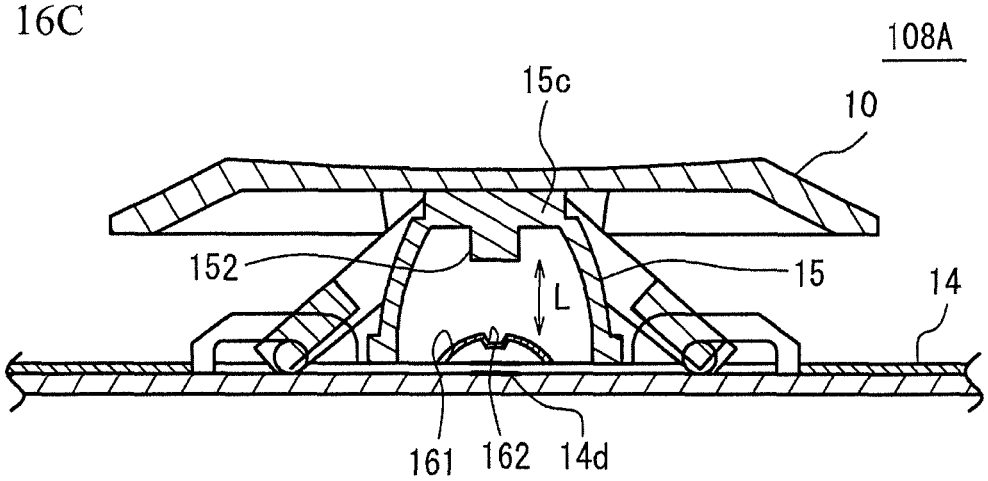
FIG. 16C is a cross-section diagram of a variation example of the key switch device of FIG. 16A.

FIG. 16A is a cross-section diagram of a key switch device 108 according to an eighth variation example. FIG. 16B is a cross-section diagram of the key switch device 108 according to the eighth variation example at the time of depression of the key top 10. FIG. 16C is a cross-section diagram of a variation example of the key switch device 108 of FIG. 16A.

The projection 121 extending downward is provided on the rear surface of the key top 10, as illustrated in FIG. 16A. The through hole 15*d* for passing the projection 121 is formed on the cylinder unit 15*c* of the dome rubber 15. Unlike FIG. 3, the concave unit 15*e* housing the contact depression member 16 is not formed on the cylinder unit 15*c* of the dome rubber 15. In FIG. 16A, a disk spring 161 is pasted and fixed on the membrane sheet 14. A projection 162 projecting downward is provided in the center of the disk spring 161. Moreover, the projection 162 of the disk spring 161 is disposed above the contact 14*d*. The disk spring 161 has a same elastic characteristic as the coil spring 16*b* mentioned above. At the time of un-depressing of the key top 10, the projection 121 is separated from the disk spring 161 by the distance L, and is opposite to the disk spring 161, as illustrated in FIG. 16A. At the time of depression of the key top 10, the dome rubber 15 performs buckling modification, and the projection 121 contacts the disk spring 161, as illustrated in FIG. 16B. Moreover, when the key top 10 is depressed so that the disk spring 161 is deformed, the projection 162 contacts the contact 14*d* and the contact 14*d* is turned on. The key switch device 108 of FIG. 16A also has the depression characteristic of FIG. 5A. In this case, the dotted line of FIG. 5A indicates the load displacement characteristic of the dome rubber 15, the alternate long and short dash line indicates the load displacement characteristic of the disk spring 161 as the contact depression member, and the solid line indicates the characteristic acquired by combining the load displacement characteristics of the dome rubber 15 and the disk spring 161.

Although the projection 121 extending downward is provided on the rear surface of the key top 10 in FIG. 16A, in a key switch device 108A of FIG. 16C, the projection 152 extending downward is provided in the center of the cylinder unit 15*c* of the dome rubber 15. Here, the through hole 15*d* is not formed on the cylinder unit 15*c* of the dome rubber 15. Other elements of the key switch device 108A of FIG. 16C are the same as corresponding elements of the key switch device 108 of FIG. 16A. Therefore, the key switch device 108A of FIG. 16C also has the depression characteristic of FIG. 5A.

As with the key switch devices 100 and 101, the key switch devices 108 and 108A also can make the operation feeling and the contact depression operation correspond well, and the thickness (i.e., height) of the key switch devices 108 and 108A can be reduced. Moreover, in the key switch devices 108 and 108A according to eighth variation example, the disk spring 161 is mounted on the membrane sheet 14 so that the projection 162 of the disk spring 161 is disposed above the contact 14*d* of the membrane sheet 14. Thereby, an accuracy which depresses the center of the contact 14*d* can be improved, and fluctuation of the ON-load (i.e., the load required to turn on the contact 14*d*) by fluctuation of depression position of the contact 14*d* can be reduced.

Although in the key switch devices 107, 107A, 108 and 108A, the two gear links are constructed in the shape of the reverse V-character, the two gear links may be constructed in the shape of the V-character, as illustrated in FIG. 4.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A reaction force generating member, comprising:

a first unit that has a first load displacement characteristic in which a depression load of an operation member increases until the first unit elastically buckles and deforms, and the depression load of the operation member decreases after the first unit is elastically buckled and deformed, according to depression of the operation member;

a second unit that is moved by the deformation of the first unit between a first position contacting the first unit and a second position contacting the first unit and depressing a switch disposed below the operation member, and has a second load displacement characteristic in which the depression load of the operation member increases at least until the switch is turned on according to an amount of depression of the operation member, wherein a load is not applied to the second unit until the amount of the depression of the operation member reaches a given amount, and a load of the second unit increases after the amount of the depression of the operation member has reached the given amount, and the given amount is larger than the amount of the depression of the operation member at which the first unit is elastically buckled and deformed.

2. The reaction force generating member as claimed in claim 1, wherein an increased amount of the depression load of the operation member according to the amount of depression of the operation member is smaller than a decreased amount of the depression load of the operation member after the elastic buckling deformation.

3. The reaction force generating member as claimed in claim 1, wherein the second unit contacts the first unit by being formed integrally with the first unit.

4. The reaction force generating member as claimed in claim 1, wherein the first unit inclines from a vertical direction by an angle less than 45 degrees, and the second unit has a half apex angle of 45 degrees or more.

5. The reaction force generating member as claimed in claim 1, wherein the first unit comprises:

a base unit;

an outer dome unit that inclines diagonally upward from the base unit; and a cylinder unit extending upwardly from the outer dome unit, wherein the second unit extends in a reverse conical shape from the cylinder unit.

6. The reaction force generating member as claimed in claim 5, wherein the reverse conical shape is a reverse polygonal cone shape or a reverse truncated cone shape.

7. The reaction force generating member as claimed in claim 5, wherein the base unit is integrally formed with the first unit.

8. A reaction force generating member, comprising:

a first unit that has a first load displacement characteristic in which a depression load of an operation member increases until the first unit elastically buckles and deforms, and the depression load of the operation member decreases after the first unit is elastically buckled and deformed, according to depression of the operation member; and a second unit that depresses a switch disposed below the operation member, and has a second load displacement characteristic in which the depression load of the operation member increases at least until the switch is turned on according to an amount of depression of the operation member, wherein the first unit is formed integrally with the second unit, and wherein a load is not applied to the second unit until the amount of the depression of the operation member reaches a given amount, and a load of the second unit increases after the amount of the depression of the operation member has reached the given amount, and the given amount is larger than the amount of the depression of the operation member at which the first unit is elastically buckled and deformed.

9. The reaction force generating member as claimed in claim 8, wherein an increased amount of the depression load of the operation member according to the amount of depression of the operation member is smaller than a decreased amount of the depression load of the operation member after the elastic buckling deformation.

10. The reaction force generating member as claimed in claim 8, wherein the first unit inclines from a vertical direction by an angle less than 45 degrees, and the second unit has a half apex angle of 45 degrees or more.

11. The reaction force generating member as claimed in claim 8, further comprising:

a base unit; and a cylinder unit that extends upwardly from the first unit, wherein the first unit extends diagonally upward from the base unit, and the second unit extends in a reverse conical shape from the cylinder unit.

12. The reaction force generating member as claimed in claim 11, wherein the second unit extends in a reverse polygonal cone shape or reverse truncated cone shape from the cylinder unit.

13. A switch actuator, comprising:

a dome-shaped member composed of a rubber material as one piece, wherein the dome-shaped member includes a ring-shaped base, an outer dome that inclines diagonally upward from the base, a cylinder that extends upwardly from the outer dome, and an inner dome that extends in a reverse conical shape from the cylinder, and wherein the outer dome functions as a reaction force generating member that moves the inner dome when the outer dome is depressed, and the inner dome functions as a depression member for the switch.

14. The switch actuator as claimed in claim 13, wherein the outer dome inclines from a vertical direction by an angle greater than 45 degrees.

15. The switch actuator as claimed in claim 13, wherein the inner dome has a half apex angle θ of 45 degrees or more.

* * * * *